United States Patent [19]

Blattner

[11] Patent Number: 4,655,104

[45] Date of Patent: Apr. 7, 1987

[54] ADJUSTABLE TORQUE WRENCH

[75] Inventor: Raymond J. Blattner, Palos Hills, Ill.

[73] Assignee: Ryeson Corporation, Franklin Park, Ill.

[21] Appl. No.: 816,273

[22] Filed: Jan. 6, 1986

[51] Int. Cl.[4] ..... B25B 23/142

[52] U.S. Cl. ..... 81/483

[58] Field of Search ..... 81/478, 480, 481, 482, 81/483

[56] References Cited

U.S. PATENT DOCUMENTS 2,887,921 5/1959 Livermont ..... 81/483

4,248,107 2/1981 Blattner ..... 81/483

*Primary Examiner*—Frederick R. Schmidt

*Assistant Examiner*—Debra S. Meislin

*Attorney, Agent, or Firm*—Richard W. Carpenter

[57] ABSTRACT

An improved adjustable torque wrench that includes a slidably interconnected load screw and adjusting screw positioned within a telescoping lever arm and handle, and also includes a slidable and rotatable adjustment connection between the load and adjusting screws and the handle and lever arm which permits adjusting of the torque setting by a push-pull action of the handle relative to the lever arm.

14 Claims, 6 Drawing Figures

ADJUSTABLE TORQUE WRENCH

BACKGROUND OF THE INVENTION

1. Field of the Invention

This invention relates generally to adjustable torque wrenches, and more particularly to an improvement in a means for facilitating the rapid adjustment of the torque value of the wrench and also for preventing the accidental changing of the torque value after the adjustment has been made.

2. Description of the Prior Art

This invention is directed to an improvement in the adjusting torque wrench described and claimed in U.S. Pat. No. 4,248,107, which patent discloses an arrangement with a slidable latch member and spring means urging the latch member in one direction to prevent the accidental misadjustment of the torque value of the wrench.

The invention of the present application contemplates an improvement of the locking means which makes it easier to operate and more reliable from the standpoint of accidental misadjustment of the wrench torque value.

Applicant is unaware of any prior art patent which teaches the specific locking arrangement of the present invention.

SUMMARY OF THE INVENTION

It is an object of the present invention to provide, in an adjustable torque wrench, an improved locking mechanism that is simple in construction and provides positive retention of a preselected torque to prevent accidental change in the torque value.

Another object of the invention is the provision, in a wrench of the type described, of a locking mechanism which may be operated very simply and very quickly to provide a sure lock between certain moving parts of the torque wrench.

A more specific object of the invention is the provision of a locking mechanism, in a wrench of the type described, which permits the torque value of the wrench to be adjusted by moving the handle to one position, and which prevents the torque value from being changed when the handle is moved to another position.

These and other objects of the invention will be apparent from an examination of the following description and drawings.

Figures 1, 2, 3, 4:
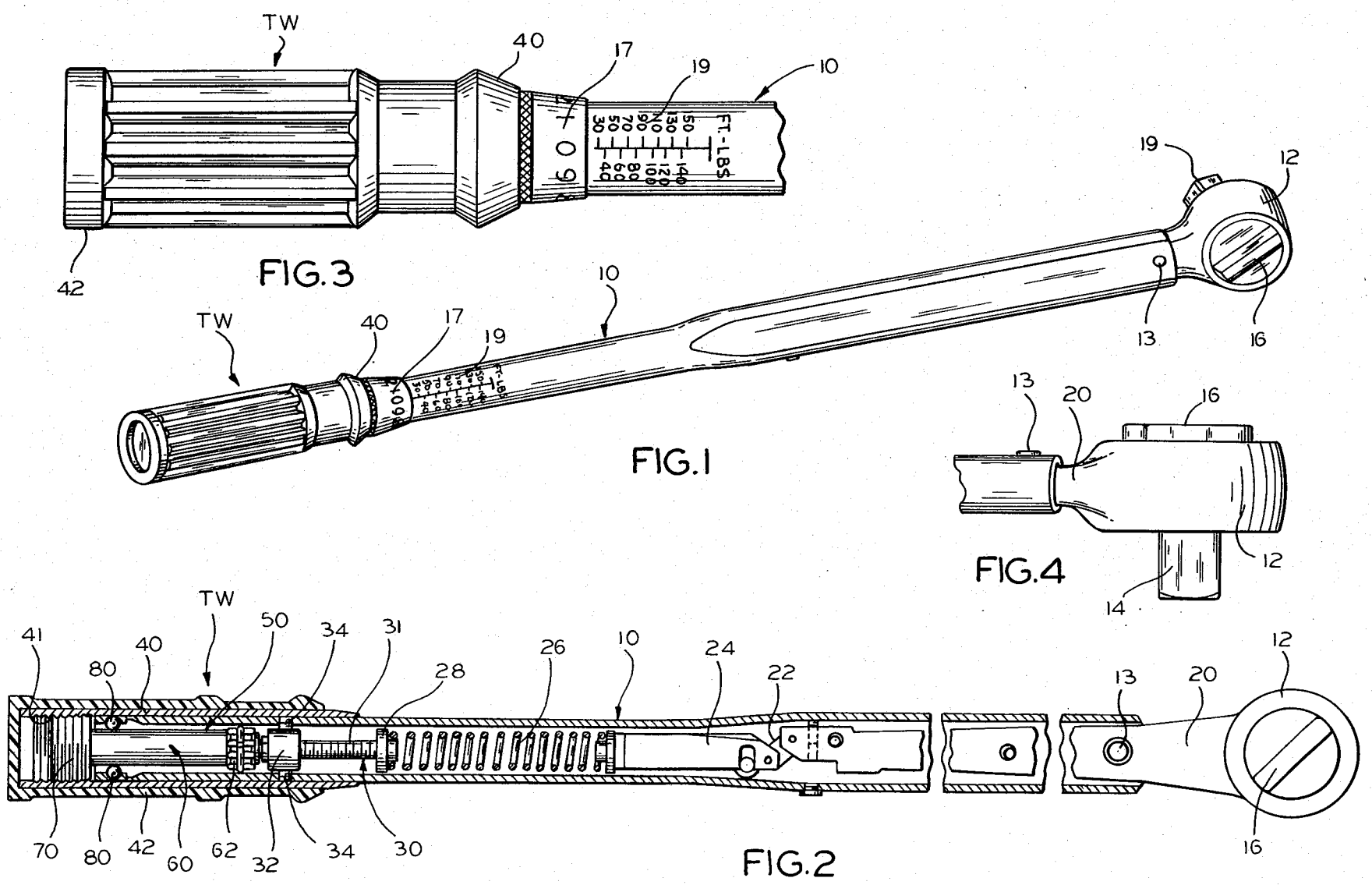
FIG. 1 is a fragmentary isometric view of an adjustable torque wrench embodying features of the invention.
FIG. 2 is a fragmentary longitudinal vertical sectional view of the structure illustrated in FIG. 1.
FIG. 3 is an enlarged side elevational view of a portion of the structure illustrated in FIG. 1.
FIG. 4 is an enlarged plan view of a portion of the structure illustrated in FIG. 1.

It will be understood that, for purposes of clarity, certain elements may have been intentionally omitted from certain views where they are believed to be illustrated to better advantage in other views.

DESCRIPTION OF THE PREFERRED EMBODIMENT

Referring now to the drawings for a better understanding of the invention, it will be seen that the novel torque wrench embodying features of the invention is indicated at TW in the drawings. It includes a hollow generally cylindrical lever arm 10 having at, one end thereof, a grip member indicated generally at 40 and having, at the other end thereof, a head 12 which is secured thereto by means of a pivot pin 13. The head 12 may be provided with an outwardly projecting square drive 14 for attachment to a socket or the like. The head may also be provided with reversing lever 16, so that the torque wrench may be moved either clockwise or counter-clockwise to accomplish the desired objective.

As best seen in FIGS. 1 and 3, the torque wrench is of the pre-settable type, and a scale in foot pounds of torque, indicated generally at 19, can be seen on the lever arm adjacent the grip member 40. Encircling the grip member 40 adjacent to the foot-pound scale is a series of numbers, indicated generally at 17, which range from 0 through 9. They are arranged to line up with the foot-pound scale to indicate the torque preset into the torque wrench to the nearest foot pound. This scale arrangement is similar to that commonly used in micrometers.

A locking mechanism or control means, described later in the specification, serves to positively lock the grip member 40 to the lever arm 10 to prevent relative rotation therebetween after the preselected torque value has been determined and set.

Referring now to FIG. 2 of the drawings, it can be seen that the head 12 includes a shank portion 20 that extends into the interior of lever arm 10. The shank 20 is connected by means of an offset link 22 with the spring follower member 24.

A compression spring 26 positioned within the lever arm 10 has its forward end in engagement with the spring follower 24 and its rearward end in engagement with the spring plate 28 that is affixed to or engagable with a threaded adjusting screw 30.

The adjusting screw 30 has a threaded front end 31 threadably received within a threaded nut or bushing 32 which is secured within the lever arm 10 by means of a pair of pins or set screws 34. Thus, the bushing 32 is prevented from movement relative to the lever arm, while the threaded portion of the adjusting screw 30 can be rotated so as to move axially forward or backward relative to the bushing and lever arm, as hereinafter described.

As best seen from viewing FIG. 2, as the adjusting screw is moved forward the amount of pressure on compression spring 26 is increased, so that it requires a greater force to cause the link 22 to pivot. Thus, pivoting of the head 12 about the pivot pin 13 requires a greater torque. As previously mentioned, the pivoting action of the head 12, relative to the lever arm 10, is an indication to the operator of the torque wrench TW that the preselected torque has been reached.

Figure 5:
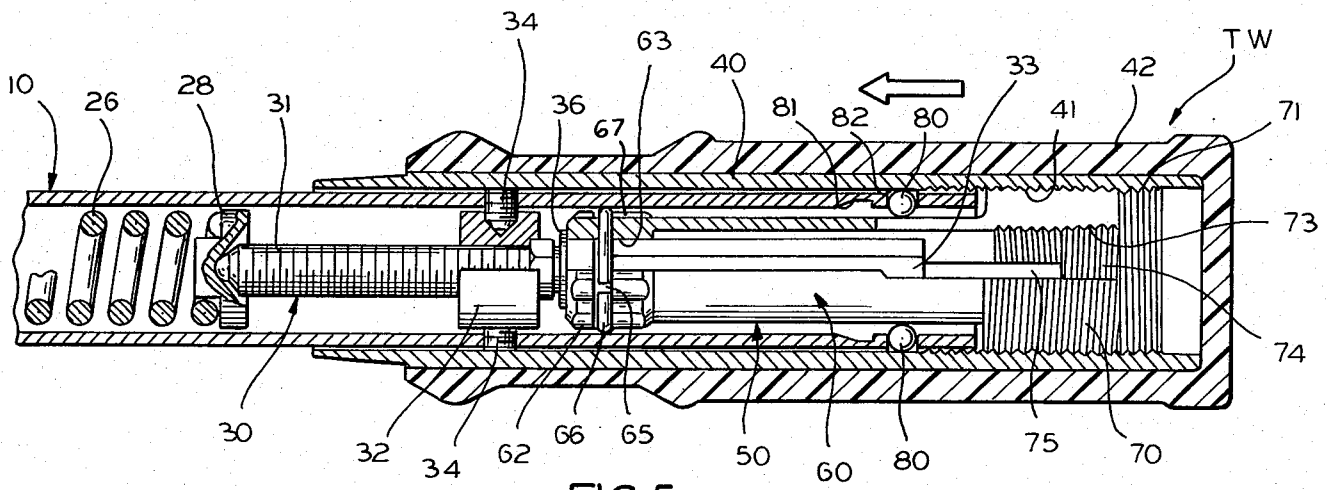
FIGS. 5 and 6 are enlarged sectional views of the operating portions of the structure illustrated in FIG. 2, as shown in the unlocked and locked positions, respectively.
Figure 6:
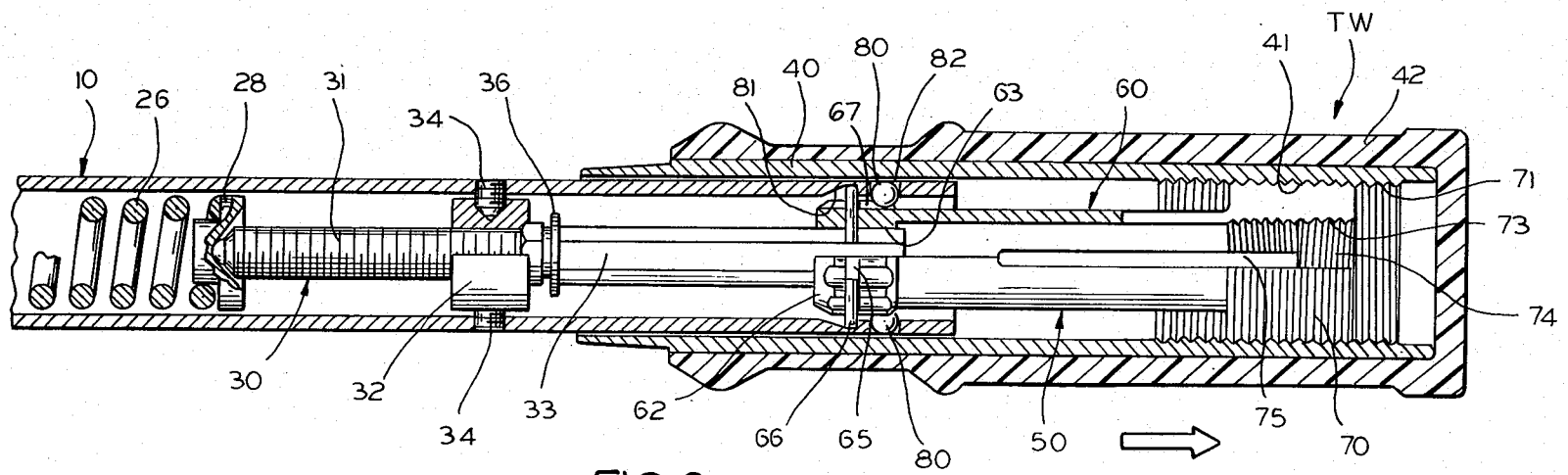

The enlarged views of FIGS. 5 and 6 illustrate in greater detail the specific torque adjusting mechanism and the locking mechanism that prevents movement of the torque adjusting mechanism after the adjusting mechanism has been set to a preselected torque.

It will be seen that a generally cylindrical hollow grip member 40 is sleeved or telescoped over the rear end of lever arm 10. Grip member 40 is provided with internal threads 41, the purpose of which is described later in the specification. A rubber cover 42 may be sleeved over the outer surface of the rear end of grip member 40 to facilitate grasping.

The control means for adjusting the pressure on the compression spring 26 includes a screw assembly, indicated generally at 50, which comprises a load screw 60 and the previously mentioned adjusting screw 30, which are disposed in telescoping relation with each other.

As previously mentioned, adjusting screw 30 has a threaded front end 31 which is engagable with the bushing 32 attached to the lever arm 10. The rear end 33 of the adjusting screw 30 has a rectilinear cross section, preferably hexagonal. When the adjusting screw is received within the load screw, as described hereinafter, there can be relative axial movement therebetween, but there cannot be relative rotative movement therebetween. Thus, when the load screw is rotated, the adjusting screw is likewise rotated to the same degree.

Intermediate its ends the adjusting screw 30 is provided with a circumferential groove, not readily seen in the drawing, within which is positioned an annular split stop ring 36. The purpose of the stop ring is to limit the forward axial movement of the load screw relative to the adjusting screw.

Still referring to FIGS. 5 and 6, it will be seen that the load screw 60 is a generally cylindrical hollow structure which can receive, in telescoping relation, the rear end of adjusting screw 30.

Load screw 60 is provided with an integral rear flange 70 and an integral front flange 62 which has a hexagonal bore 63 contoured to receive in sliding engagement the rear end of adjusting screw 30 as previously described.

Front flange 62 of load screw 60 is provided with a circumferential annular groove 65 adapted to receive a split retaining ring 66, the purpose of which is described later in the specification.

Load screw front flange 62 is also provided with a plurality of circumferentially spaced axially extending grooves 67 adapted to receive a plurality of generally spherical ball bearing type detents, indicated generally at 80, which are carried by the lever arm 10 in a manner hereinafter described.

Rear flange 70 of load screw 60 is provided with external threads 71 adapted for engagement with the internal threads 41 of grip member 40. Rear flange 70 is also provided with internal threads 73 adapted to receive an adjusting or lock plug 74. The rear portion of load screw 60 is provided with a plurality of circumferentially spaced axially extending slots 75 which permit the rear end of the load screw to be deflected or expanded outwardly as the tapered lock plug 74 is engaged in the end of the load screw. The purpose of the lock plug is to tighten the connection between the load screw and the grip member and prevent further relative rotation therebetween, after the wrench has been calibrated to the accurate torque adjustments required. When this has been accomplished, the lock plug is tighted into the end of the load screw 60 to limit movement of the load screw relative to the grip member, so that when the grip member is rotated the load screw will be rotated with it in the same direction and to the same extent.

Still referring to FIGS. 5 and 6, it will be seen that, adjacent its rear extremity, lever arm 10 presents a pair of diametrically opposed aperatures 82 each adapted to hold a ball bearing detent 80, and forwardly of the apertures 82 an internal, annular, circumferential groove 81 which is tapered slightly and is adapted to receive the retaining ring 66 which is carried within the circumferential groove 65 of the load screw 60.

To describe the operation of the invention, in order to change the torque value of the wrench the adjusting means must be moved from the locked position of FIG. 6 to the unlocked position of FIG. 5.

It will be seen that when the grip member is in its rearwardmost position, as shown in FIG. 6, the detent 80 are received within the axial grooves 67 of the load screw front flange 62 to prevent rotation of the load screw, and grip member, relative to the lever arm. The stop ring 66 limits the rearward movement of the load screw, grip member, as it becomes engaged within the groove 81 of the lever arm 10.

In order to change the setting of the torque value, the grip member is moved forward, relative to the lever arm, from the locked position shown in FIGS. 6 to the unlocked position shown in FIG. 5. As this is done the stop ring 66 moves out of groove 81 of the lever arm and the detents 80 move out of the axial grooves 67 of the load screw to permit the load screw to be rotated relative to the lever arm by means of rotation of the grip member. As the grip member is rotated the load screw is rotated, and also the adjusting screw is rotated, to change the pressure on compression spring 26. After the desired setting has been reached, the grip member is pulled back to its rearward or locked position, as shown in FIG. 6, and the wrench can be used without fear of accidentally changing the preselected torque value.

What is claimed is:

1. In an adjustable torque wrench having a head, a hollow lever arm pivotally connected at one end to said head, a hollow rotatable grip member telescoped over a portion of another end of said lever arm, adjustable means disposed within said lever arm and grip member for preventing pivoting of said head relative to said arm until the torque on said head exceeds a preselected value, means for adjustment of said torque value, and control means positioned within said lever arm and grip member for selectively permitting and preventing the adjustment of the torque value, said control means comprising:

(a) an adjusting screw having one end in threaded engagement with said lever arm to permit relative rotative and axial movement therebetween;

(b) a load screw having one end in threaded engagement with said grip member to permit rotative movement and axial movement therewith;

(c) said adjusting and load screws having other ends disposed in telescoping interlocking relation with each other to permit relative axial movement and prevent relative rotative movement therebetween;

(d) lock means carried in said lever arm for selective engagement and disengagement with said load screw for allowing and preventing the rotation of said adjustment and load screws relative to said lever arm when said load screw is moved axially with said grip member relative to said adjusting screw and lever arm between preselected locked and unlocked positions.

2. In an adjustable torque wrench having a head, a hollow lever arm pivotally connected at one end to said head, a hollow rotatable grip member telescoped over a portion of another end of said lever arm, adjustable means disposed within said lever arm and grip member for preventing pivoting of said head relative to said arm until the torque on said head exceeds a preselected value, means for adjustment of said torque value, and control means positioned within said lever arm and grip member for selectively permitting and preventing the adjustment of the torque value, said control means comprising:

(a) an adjusting screw having one end in threaded engagement with said lever arm to permit relative rotative and axial movement therebetween;

(b) a load screw having one end in threaded engagement with said grip member to permit rotative movement relative thereto and both rotative and axial movement therewith;

(c) said adjusting and load screws having other ends disposed in telescoping interlocking relation with each other to permit relative axial movement and prevent relative rotative movement therebetween;

(d) detent means in said lever arm for selective engagement and disengagement with groove means in said load screw for allowing and preventing the rotation of said screws relative to said lever arm when said load screw is moved axially with said grip member relative to said adjusting screw and lever arm between preselected locked and unlocked positions.

3. In an adjustable torque tool having a head, a hollow lever arm pivotally connected at one end to said head, a hollow rotatable grip member telescoped over a portion of another end of said lever arm, adjustable means disposed within said lever arm for preventing pivoting of said head relative to said arm until thr torque on said head exceeds a preselected value, means for adjustment of said torque value, and control means positioned within said lever arm and grip member for selectively permitting and preventing the adjustment of the torque value, said control means comprising:

(a) an adjusting screw in threaded engagement with said lever arm to permit relative rotative and axial movement therebetween;

(b) a load screw disposed in threaded engagement with said grip member to permit rotative movement and axial movement therewith;

(c) said adjusting and load screws being disposed in telescoping interlocking relation with each other to permit relative axial movement and prevent relative rotative movement therebetween;

(d) lock means carried in said lever arm for selective engagement and disengagement with said load screw for allowing and preventing the rotation of said adjustment and load screws relative to said lever arm when said load screw is moved axially with said grip member relative to said adjusting screw and lever arm between preselected locked and unlocked positions.

4. A wrench according to claim 1, wherein one end of said adjusting screw is threaded for engagement with a bushing secured to said lever arm, and the other end of said adjusting screw is rectilinear in cross section for sliding, axial, non-rotative movement relative to said load screw.

5. A wrench according to claim 1, and including a stop ring carried by said adjusting screw, intermediate it ends, for limiting relative axial movement in one direction between said adjusting screw and said load screw.

6. A wrench according to claim 1, wherein said adjusting screw is threadably connected to said lever arm by means of a bushing fixedly secured within said lever arm and threadably receiving said adjusting screw.

7. A wrench according to claim 1, wherein said load screw has, at said other end thereof, a central rectilinear opening for slidably and non-rotatably receiving an end of said adjusting screw.

8. A wrench according to claim 1, wherein said load screw has at one end thereof, a flange presenting at least one axially extending opening for receiving said lock means.

9. A wrench according to claim 1, wherein said load screw has, at one end thereof, a flange presenting a plurality of circumferentially spaced, axially extending grooves for receiving detents carried by said lever arm.

10. A wrench according to claim 1, wherein one end of said load screw has external threads for engagement with said grip member and internal threads for engagement with an adjusting lock plug.

11. A wrench according to claim 1, wherein said load screw carries a stop ring engagable with an annular groove in said lever arm for limiting relative axial movement in one direction between said lever arm and said load screw.

12. A wrench according to claim 1, wherein said load screw has at said other end thereof an integral flange with a central rectilinear opening for slidably and non-rotatably receiving said adjusting screw and a plurality of circumferentially spaced axially extending grooves to receiving detents carried by said lever arm.

13. A wrench according to claim 1, wherein said lever arm presents a pair of apertures holding spherical detent elements engagable with axially extending grooves on said load screw for accommodating rotative movement of said load screw and grip member relative to said lever arm when said detent elements are engaged within said grooves.

14. A wrench according to claim 1, wherein said lever arm presents a pair of apertures and a groove disposed adjacent each other for receiving detent elements and a stop ring, respectively.

* * * * *